US008915607B2

(12) United States Patent
Yang

(10) Patent No.: US 8,915,607 B2
(45) Date of Patent: Dec. 23, 2014

(54) AQUA LAMP STRUCTURE HAVING LIGHT TRANSMISSIVE CANDLE

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 64 days.

(21) Appl. No.: 13/802,827

(22) Filed: Mar. 14, 2013

(65) Prior Publication Data

US 2014/0268672 A1 Sep. 18, 2014

(51) Int. Cl.

| | |
|---|---|
| ***F21V 9/12*** | (2006.01) |
| ***F21V 11/00*** | (2006.01) |
| ***F21V 31/04*** | (2006.01) |
| ***F21V 21/14*** | (2006.01) |

(52) U.S. Cl.

CPC ..... *F21V 31/04* (2013.01); *F21V 11/00* (2013.01); *F21V 21/14* (2013.01); *Y10S 362/804* (2013.01)

USPC ..... 362/101; 362/96; 362/318; 362/804

(58) Field of Classification Search

USPC ..... 362/96, 101, 318, 804

See application file for complete search history.

(56) References Cited

U.S. PATENT DOCUMENTS

| | | | | |
|---|---|---|---|---|
| 5,272,604 | A * | 12/1993 | Lin | 362/96 |
| 6,241,359 | B1 * | 6/2001 | Lin | 362/96 |
| 6,295,749 | B1 * | 10/2001 | Lin | 40/406 |
| 6,877,883 | B2 * | 4/2005 | Lau Ting Yup et al. | 362/363 |
| 7,762,682 | B2 * | 7/2010 | Yang | 362/155 |

* cited by examiner

*Primary Examiner* — Peggy Neils
(74) *Attorney, Agent, or Firm* — Leong C. Lei

(57) ABSTRACT

The application is related to an aqua lamp structure having a light transmissive candle, mainly comprising an aqua lamp decoration having a light transmissive candle thereon; the aqua lamp decoration comprises a base upwardly mounted to an aqua lamp main body; the light transmissive candle comprises a hollow and transparent cage, and the cage comprises a lighting unit and a pattern film surroundingly set at outer edge of the lighting unit, and outer shell wall of the cage has a pattern layer, and the pattern layer has grain to project the patterns of the pattern film on the cage by the light of the lighting unit to be crossed and overlapped with the grain of the pattern layer on the shell wall. Thereby, due to the splendid aqua lamp main body with light to shine on, the 3D visual effects which have light and shadow in different layers, front and back, deep and shallow above the splendid aqua lamp main body can be realized.

4 Claims, 3 Drawing Sheets

AQUA LAMP STRUCTURE HAVING LIGHT TRANSMISSIVE CANDLE

TECHNICAL FIELD OF THE INVENTION

The present invention generally relates to an aqua lamp structure having a light transmissive candle, and more particularly to an aqua lamp design of object visual allocation in an environmental space for creating a spectacular visual effect with combination of the light transmissive candle and the aqua lamp.

DESCRIPTION OF THE PRIOR ART

Generally in daily life, the table ornaments on the desk, such as picture frames, toy decorations and etc, are all artistic, ornamental, static state objects. Therefore, aqua lamps design with paillette, glitter powder or decoration inside presents. By manually putting upside down, manually shaking or flowing the paillette, the glitter powder or the decoration inside by electric power, the visual perception is created thereby. With different objects inside the aqua lamps, the various visual effects can be created. The reaching possibilities, the development of the various visual variations or multifunction, interesting can be provided with. Therefore, the aqua lamps design becomes an issue for the developer of the environment ornaments.

Accordingly, the inventor of the present invention designs and creates a combination of an electronic candle to allow the light source with plenteous visual effects and an aqua lamp with dynamically rotation effect. The artistic, ornamental and interesting conditions can be improved. With constant experiments and improvements, the present invention now is created.

SUMMARY OF THE INVENTION

The primary purpose of the present invention is to provide an aqua lamp structure having a light transmissive candle mainly comprising:

an aqua lamp main body, having a light transmissive stereo-configuration to be filled in with slightly viscous flowable liquid and to be sealed, and the aqua lamp main body comprises a rotary unit therein, and the rotary unit comprises a magnetic stopper therein;

a base, having an opening upward, and the opening is fixedly mounted to the aqua lamp main body and corresponds thereto, and the base comprises at least one luminophor inside in accordance with the bottom of the aqua lamp main body, and the base comprises a magnetic rotary shaft inside to attract the magnetic stopper, and the magnetic rotary shaft is driven and rotated by a power unit, and the rotary unit is rotated with attraction of the magnetic rotary shaft under a rotating condition of the magnetic rotary shaft;

a lighting unit, comprising two luminophors and a printed circuit board, and the two luminophors are up and bottom separated and positioned above the printed circuit board, and the printed circuit board is fixed on the aqua lamp main body;

a pattern film, surroundingly set at outer edge of the lighting unit, and the pattern film has patterns on its surface; and a cage, being formed hollow and transparent, and having an opening at one end, and a shell wall of the cage has a pattern layer, and the pattern layer has grain, and the cage overcovers the outer edge of the pattern film, and is combined on the aqua lamp main body. By projecting the patterns of the pattern film on the cage by the light of the lighting unit to be crossed and overlapped with the grain of the pattern layer on the shell wall, thereby. The 3D visual effects which have light and shadow in different layers, front and back, deep and shallow above the splendid aqua lamp main body can be realized due to the splendid aqua lamp main body with light to shine on.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
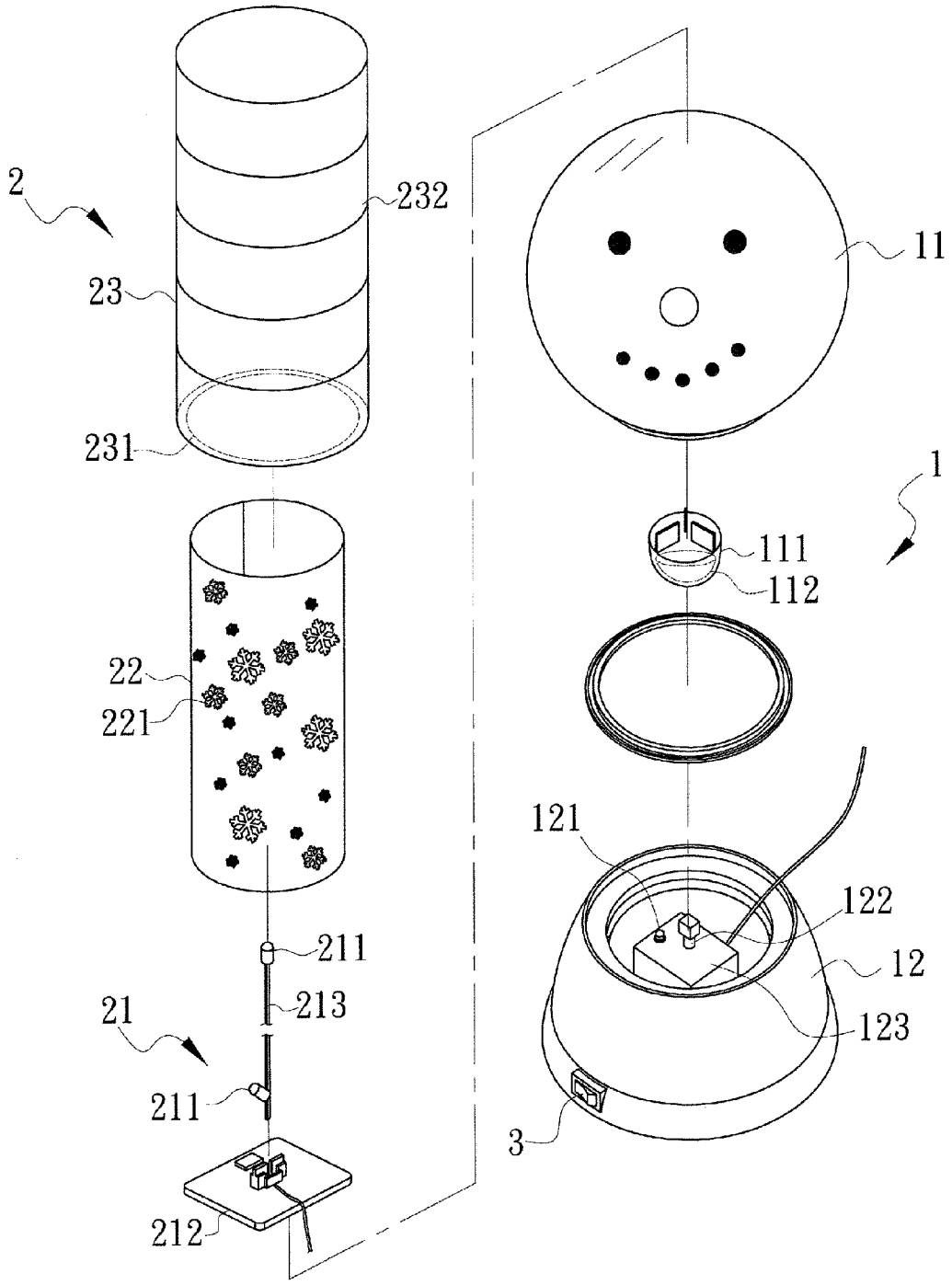
FIG. 1 is an exploded view diagram of the present invention.
Figure 2:
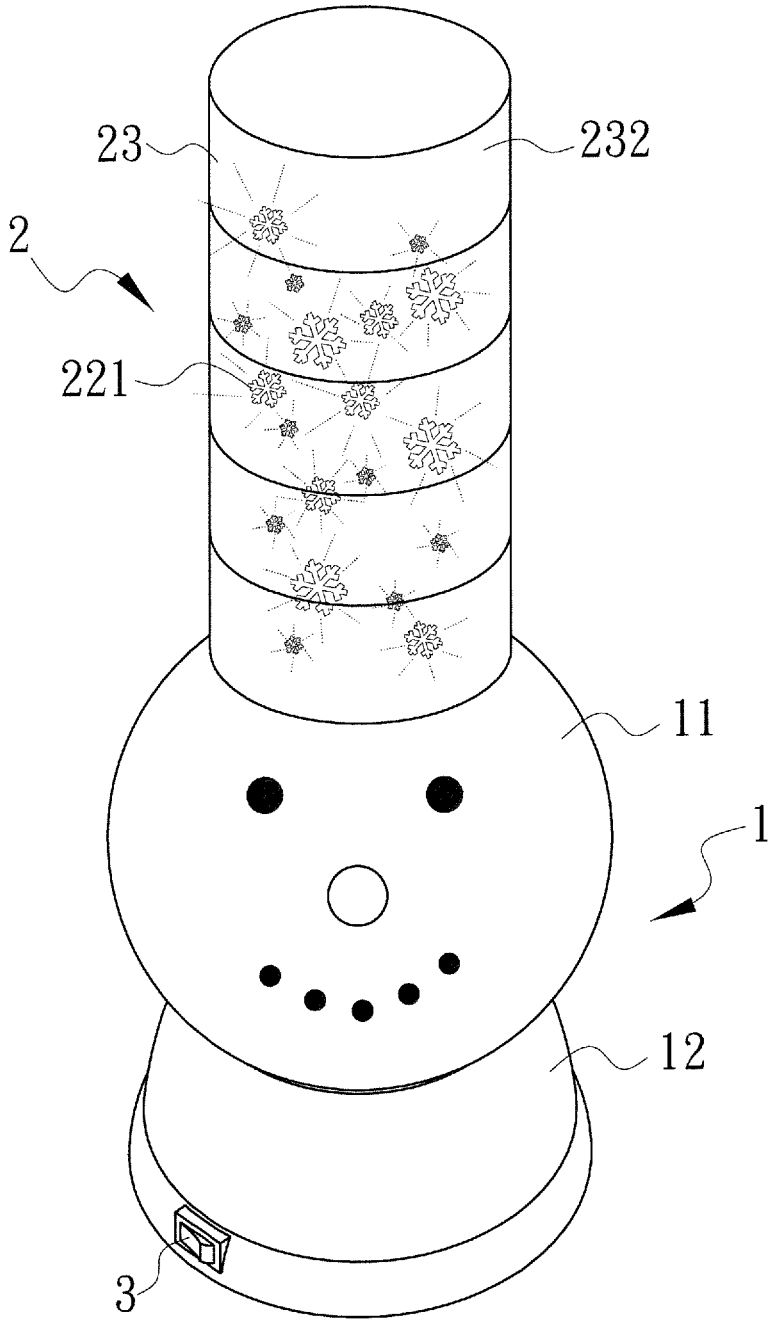
FIG. 2 is a perspective diagram of the present invention.
Figure 3:
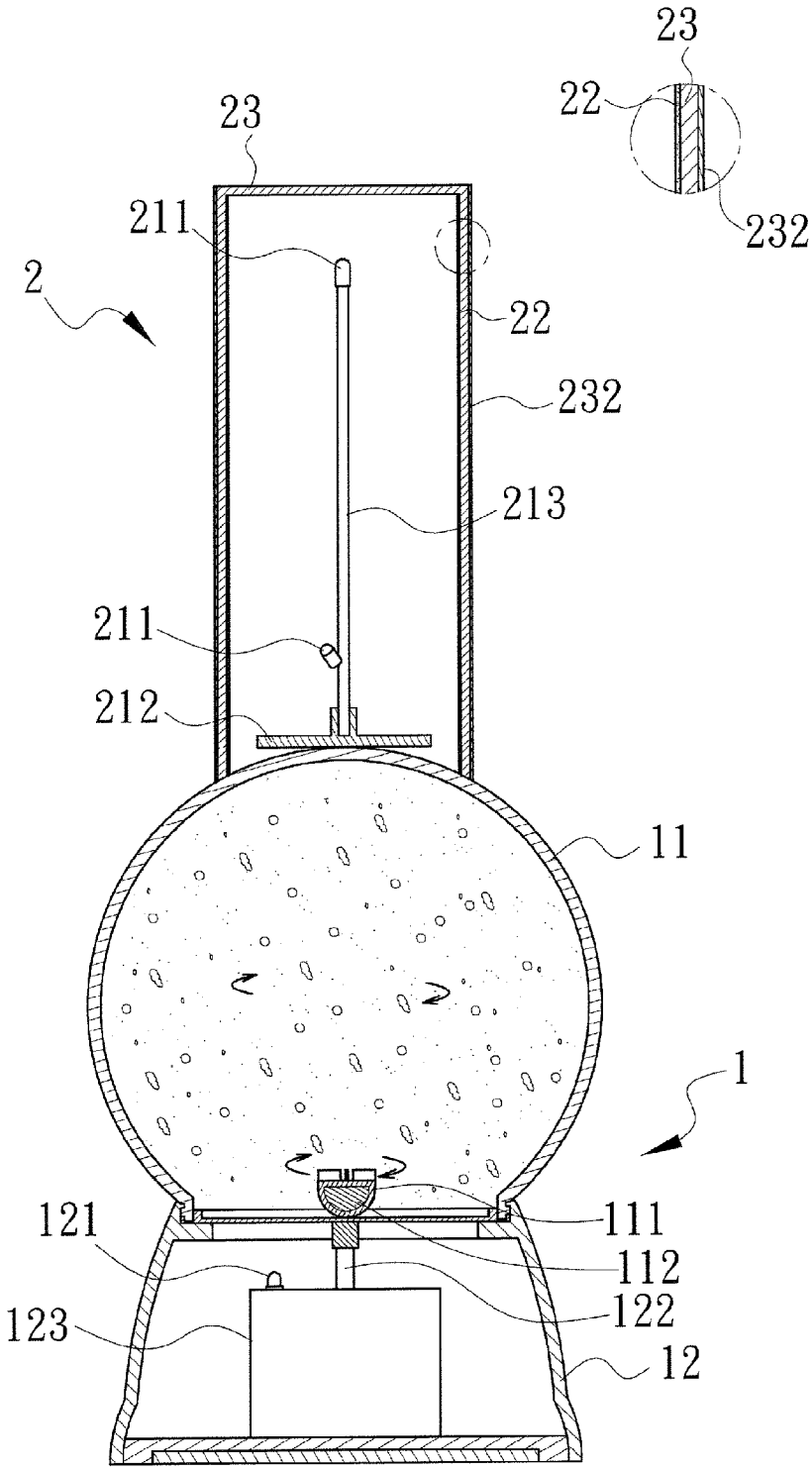
FIG. 3 is a sectional diagram of the present invention.

Please refer to FIG. 1 to FIG. 3, which show an aqua lamp structure having a light transmissive candle of the present invention, mainly comprising an aqua lamp decoration 1 and a light transmissive candle 2. The light transmissive candle 2 is fixed on the aqua lamp decoration 1.

The aqua lamp decoration 1 comprises:

a aqua lamp main body 11, having a light transmissive stereo-configuration to be filled in with slightly viscous flowable liquid, paillette, glitter powder and to be sealed, and the aqua lamp main body 11 comprises a rotary unit 111 therein, and the rotary unit 111 comprises a magnetic stopper 112 therein;

a base 12, having an opening upward, and the opening is fixedly mounted to the aqua lamp main body 11 and corresponds thereto, and the base 12 comprises at least one luminophor 121 inside in accordance with the bottom of the aqua lamp main body 11 to irradiate the light transmissive aqua lamp main body 11 for increasing the spectacular visual effect, and the base 12 comprises a magnetic rotary shaft 122 inside to attract the magnetic stopper 112, and the magnetic rotary shaft 122 is driven and rotated by a power unit 123, and the rotary unit 111 is rotated with attraction of the magnetic rotary shaft 122 under a rotating condition of the magnetic rotary shaft 122;

The light transmissive candle 2 comprises:

a lighting unit 21, comprising two luminophors 211 and a printed circuit board 212, and the two luminophors 211 are up and bottom separated and positioned at the upper portion of a cylinder 213, and the cylinder 213 is mounted on the printed circuit board 21, and the printed circuit board 212 is fixed on the aqua lamp main body 11 for controlling the on and off of the luminophors 211; the luminophors 211 are color LEDs, and the printed circuit board 212 is provided to control the color sequences and laminating time of the luminophors 211;

a pattern film 22, surroundingly set at outer edge of the lighting unit 21, and the pattern film 22 are flexible plastic sheet and has patterns 221 on its surface;

a cage 23, being formed hollow and transparent, and having an opening 231 at one end, and a shell wall of the cage 23 has a pattern layer 232, and the pattern layer 232 has grain, and the cage 23 overcovers the outer edge of the pattern film 22, and is combined on the aqua lamp main body 11.

In this embodiment, the driving power of the power unit 123 and the necessary power for the lighting unit 21 are controlled by a switch 3. The power supply can be assembled battery, or an alternating current/direct current supply. The power supply source can be possibly various and is not restricted in claims, the detail description is omitted hereby.

Furthermore, the pattern layer 232 can be formed by sand spraying, pulverization on the shell wall of the cage 23. The grain thereof can be present in formations of fretworks, colorful paints or pasters. In this embodiment, the grain is in a formation of stripe. The luminophors 211 can be replaced by lighting pillars to increase the sense of plenteousness and continuous lighting effect.

In the present invention, with the rotation of the rotary unit 111, the liquid inside the aqua lamp main body 11 is toggled by the rotary unit 111 and the paillette, the glitter powder previously sank at the bottom now drift along. Different visual perception can be created. Meanwhile, the luminophor s121 also generates lights from the bottom of the aqua lamp main body 11 to light the light transmissive aqua lamp main body 11 to increase the spectacular visual effect.

Meanwhile, by using the luminophors 211 to light the pattern film 22, the patterns 221 of the pattern film 22 is projected on the cage 23 to be crossed and overlapped with the grain of the pattern layer 232. On the cage 23, the light and the shadow in different layers, even the 3D visual effects can be shown. Accordingly, the ambient light with decoration function can be presented.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An aqua lamp structure having a light transmissive candle, mainly comprising:

an aqua lamp main body, having a light transmissive configuration to be filled in with slightly viscous flowable liquid and to be sealed, and the aqua lamp main body comprises a rotary unit therein, and the rotary unit comprises a magnetic stopper therein;

a base, having an upward opening, and the opening is fixedly mounted to the aqua lamp main body, the base comprising at least one luminophor inside, and the base comprises a magnetic rotary shaft inside to attract the magnetic stopper, and the magnetic rotary shaft is driven and rotated by a power unit, and the rotary unit is rotated with attraction of the magnetic rotary shaft under a rotating condition of the magnetic rotary shaft;

a lighting unit, comprising two luminophors and a printed circuit board, and the two luminophors are vertically spaced from each other and positioned above the printed circuit board, and the printed circuit board is fixed on the aqua lamp main body;

a pattern film surrounding an outer edge of the lighting unit, the pattern film having patterns on its surface; and a hollow transparent cage having an opening at one end, a shell wall of the cage having a pattern layer, and the cage enclosing the outer edge of the pattern film, and being positioned on the aqua lamp main body.

2. The aqua lamp structure having a light transmissive candle according to claim 1, wherein said luminophor is a light emitting diode.

3. The aqua lamp structure having a light transmissive candle according to claim 1, wherein said magnetic rotary shaft is a driving shaft comprising a magnetic component positioned on the top thereof.

4. The aqua lamp structure having a light transmissive candle according to claim 1, wherein said pattern layer is attached to an outer shell wall of the cage.

* * * * *